US010889134B2

(12) United States Patent
Ishida et al.

(10) Patent No.: US 10,889,134 B2
(45) Date of Patent: Jan. 12, 2021

(54) PRINTING APPARATUS

(71) Applicant: CANON KABUSHIKI KAISHA, Tokyo (JP)

(72) Inventors: Takaaki Ishida, Kawasaki (JP); Seiji Ogasawara, Machida (JP); Masakazu Tsukuda, Yokohama (JP); Shuichi Tokuda, Kawasaki (JP); Masaaki Matsuura, Kawasaki (JP); Kazuki Matsuo, Kawasaki (JP); Tomofumi Nishida, Kawasaki (JP); Yuna Hattori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/269,624

(22) Filed: Feb. 7, 2019

(65) Prior Publication Data

US 2019/0240996 A1 Aug. 8, 2019

(30) Foreign Application Priority Data

Feb. 8, 2018 (JP) ..... 2018-021193

(51) Int. Cl.
*B41J 11/00* (2006.01)
*B41J 13/00* (2006.01)
(Continued)

(52) U.S. Cl.
CPC ..... *B41J 11/006* (2013.01); *B41J 2/155* (2013.01); *B41J 2/21* (2013.01); *B41J 11/0095* (2013.01);
(Continued)

(58) Field of Classification Search
CPC ..... B41J 11/006
See application file for complete search history.

(56) References Cited

U.S. PATENT DOCUMENTS 5,532,793 A * 7/1996 Kogure ..... G03G 15/234 271/184
5,933,677 A 8/1999 Lee
(Continued)

FOREIGN PATENT DOCUMENTS

CN 1168990 A 12/1997
CN 103373084 A 10/2013
(Continued)

OTHER PUBLICATIONS

Extended European Search Report dated Jul. 2, 2019, issued in corresponding European Patent Application No. 19155511.9.
(Continued)

*Primary Examiner* — Shelby L Fidler
(74) *Attorney, Agent, or Firm* — Venable LLP

(57) ABSTRACT

To shorten the time to be taken to start executing a process to handle conveyance trouble of a print medium after the occurrence of the conveyance trouble, a printing apparatus of the present invention, upon sensing of conveyance trouble by a sensing unit during a printing operation, stops the conveyance of the print medium in the conveyance trouble and any print medium located upstream of it, and moves a printing head from a first position at which the printing head performs printing on a print medium to a second position to which the printing head is retreated from the first position, in parallel with a discharge operation for conveying, to a discharge unit, any print medium located downstream of the print medium in the conveyance trouble.

18 Claims, 12 Drawing Sheets

(51) Int. Cl.

| | |
|---|---|
| ***B41J 2/155*** | (2006.01) |
| ***B65H 5/06*** | (2006.01) |
| ***B65H 7/06*** | (2006.01) |
| ***B41J 2/21*** | (2006.01) |

(52) U.S. Cl.
CPC ..... *B41J 13/0027* (2013.01); *B41J 13/0036* (2013.01); *B65H 5/062* (2013.01); *B65H 7/06* (2013.01); *B65H 2511/528* (2013.01)

(56) References Cited

U.S. PATENT DOCUMENTS

| | | | | |
|---|---|---|---|---|
| 5,970,274 | A * | 10/1999 | Rath | B65H 7/06 271/258.03 |
| 6,015,211 | A * | 1/2000 | Kinoshita | B41J 2/16547 347/109 |
| 8,419,155 | B2 | 4/2013 | Kawakami et al. | |
| 9,052,660 | B2 | 6/2015 | Mine et al. | |
| 9,302,505 | B2 | 4/2016 | Toia et al. | |
| 9,457,598 | B2 | 10/2016 | Hiroyuki et al. | |
| 9,688,084 | B2 | 6/2017 | Hiroyuki et al. | |
| 2011/0211007 | A1 * | 9/2011 | Okamoto | B41J 11/006 347/16 |
| 2013/0208043 | A1 | 8/2013 | Kawakami et al. | |
| 2013/0307893 | A1 * | 11/2013 | Suda | B41J 11/04 347/16 |
| 2014/0209653 | A1 | 7/2014 | Kikuchi | |
| 2014/0219668 | A1 | 8/2014 | Mine et al. | |
| 2015/0070426 | A1 * | 3/2015 | Nakamura | B41J 2/2146 347/12 |
| 2015/0266314 | A1 | 9/2015 | Toia et al. | |
| 2016/0274525 | A1 * | 9/2016 | Hara | G03G 15/70 |
| 2016/0288538 | A1 | 10/2016 | Suda et al. | |
| 2018/0272769 | A1 * | 9/2018 | Arakane | B41J 29/42 |

FOREIGN PATENT DOCUMENTS

| | | | |
|---|---|---|---|
| CN | 103969983 | A | 8/2014 |
| CN | 104507693 | A | 4/2015 |
| EP | 2 900 476 | A0 | 8/2015 |
| JP | 2000-289886 | A | 10/2000 |
| JP | 2013-248879 | A | 12/2013 |

OTHER PUBLICATIONS

Aug. 27, 2020 Chinese Official Action in Chinese Patent Appln. No. 201910108657.2.

* cited by examiner

PRINTING APPARATUS

BACKGROUND OF THE INVENTION

Field of the Invention

The present invention relates to a printing apparatus that performs printing on a conveyed print medium.

Description of the Related Art

Printing apparatuses have been known which continuously convey a plurality of print media by means of a plurality of drive rollers and successively perform printing on the print media thus conveyed. In such printing apparatuses, a print medium is sometimes jammed while it is conveyed. In this case, it is necessary to perform a process to solve the jam (jam process), such as removing the jammed print medium. Japanese Patent Laid-Open No. 2000-289886 discloses a technique in which, to shorten the time to be taken by such a jam process, any print medium (sheet) downstream of a jammed print medium in the direction of conveyance is discharged to the outside of the apparatus.

Here, such a printing apparatus, upon occurrence of a jam, discharges a print medium or media to the outside of the apparatus, puts the printing part to a standby state, and then prompts the user to perform a jam process. Accordingly, it takes a long time for the user to start executing a jam process after the occurrence of a jam. This makes it impossible for the user to quickly handle a jam.

SUMMARY OF THE INVENTION

The present invention has been made in view of the above problem, and an object thereof is to provide a printing apparatus capable of shortening the time to be taken for the user to start executing a process to solve conveyance trouble of a print medium, such as a jam, after the occurrence of the conveyance trouble.

In the first aspect of the present invention, there is provided a printing apparatus comprising:

a conveyance unit configured to convey a print medium;

a printing head configured to be movable between a first position at which the printing head performs a printing operation on a print medium conveyed by the conveyance unit, and a second position to which the printing head is retreated from the first position;

a discharge unit to which to discharge the print medium conveyed by the conveyance unit;

a sensing unit configured to sense conveyance trouble of a print medium conveyed by the conveyance unit; and a conveyance control unit configured to, upon sensing of conveyance trouble by the sensing unit during the printing operation by the printing head, control the conveyance unit to stop conveyance of a print medium in the conveyance trouble and continue a discharge operation for conveying a print medium located downstream of the print medium in the conveyance trouble to the discharge unit, wherein if the sensing unit senses conveyance trouble during the printing operation, the printing head moves from the first position to the second position in parallel with the discharge operation by the conveyance unit.

According to the present invention, it is possible to shorten the time to be taken for the user to start executing a process to solve conveyance trouble after the occurrence of the conveyance trouble.

Further features of the present invention will become apparent from the following description of exemplary embodiments with reference to the attached drawings.

BRIEF DESCRIPTION OF THE DRAWINGS

FIG. 9 is a diagram showing a relationship between FIGS. 9A and 9B;

DESCRIPTION OF THE EMBODIMENTS

Figure 1:
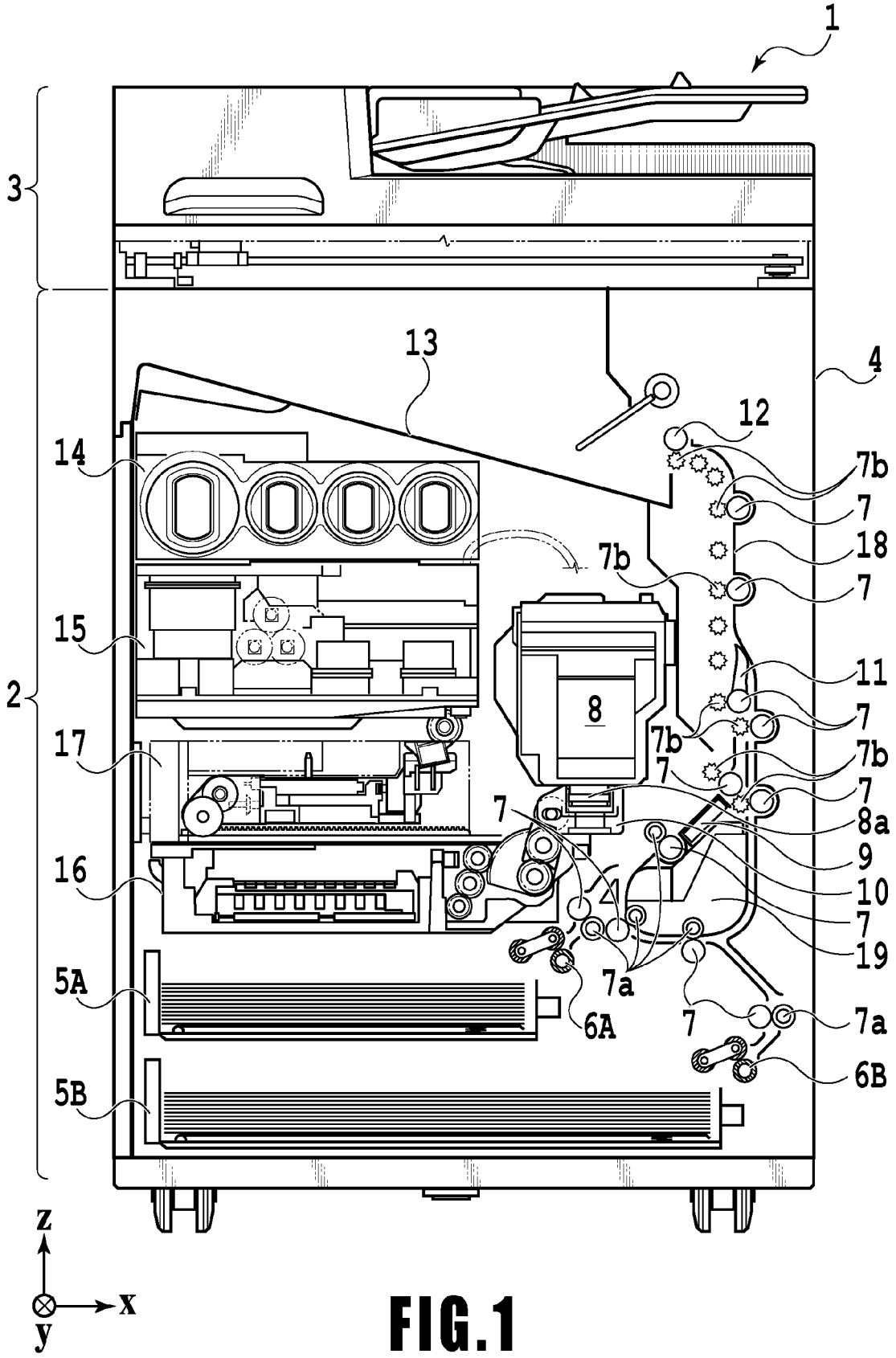
FIG. 1 is a view of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveyance rollers 7, a discharging roller 12, pinch rollers 7*a*, spurs 7*b*, a guide 18, an inner guide 19, and a flapper 11 are conveyance mechanisms for guiding a print medium S in a predetermined direction. The conveyance rollers 7 are drive rollers located upstream and downstream of the print head 8 and driven by a conveyance motor (not shown). The pinch rollers 7*a* are follower rollers that are turned while nipping a print medium S together with the conveyance rollers 7. The discharging roller 12 is a drive roller located downstream of the conveyance rollers 7 and driven by the conveyance motor (not shown). The spurs 7*b* nip and convey a print medium S together with the conveyance rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveyance path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
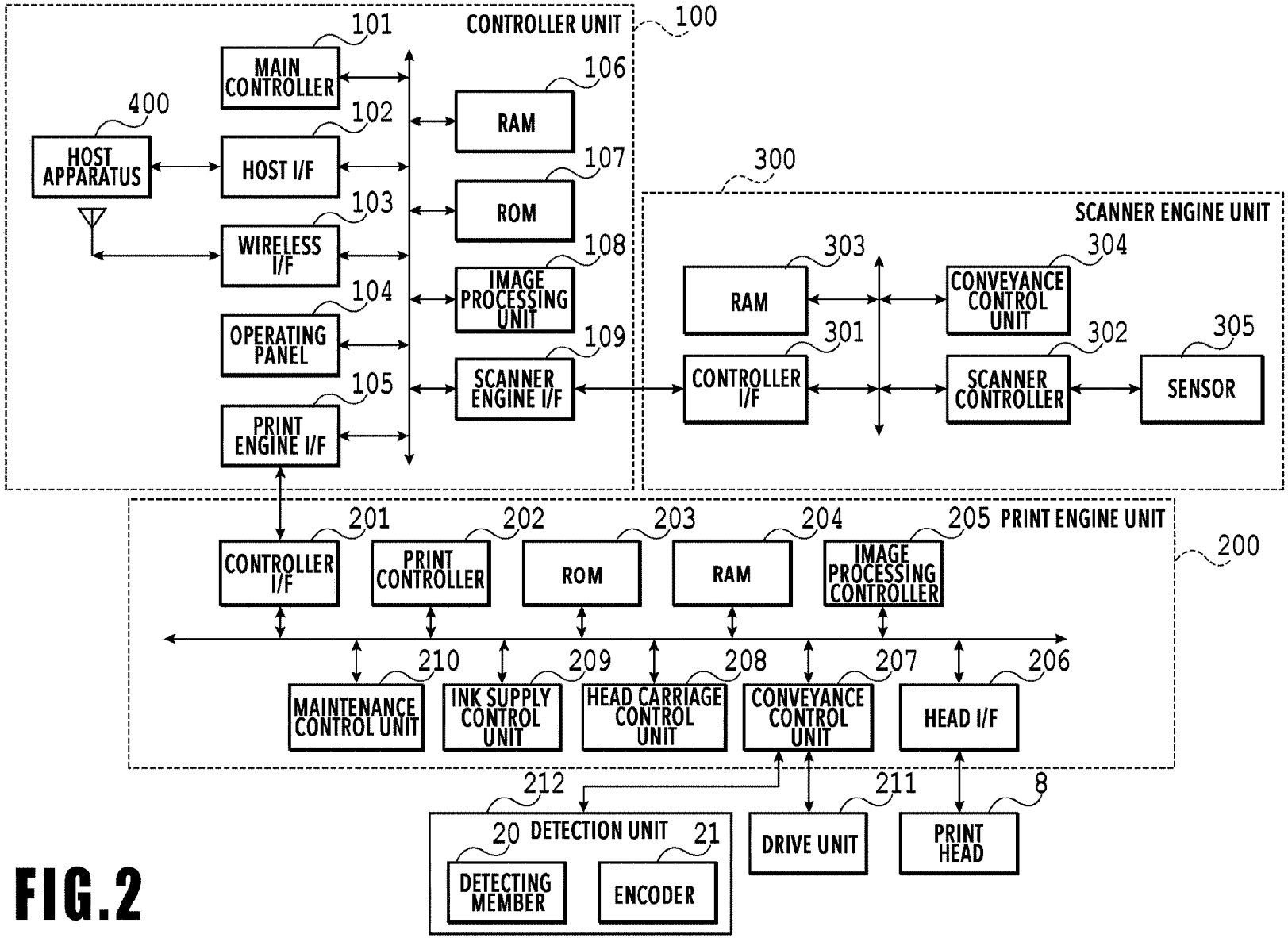
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveyance rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
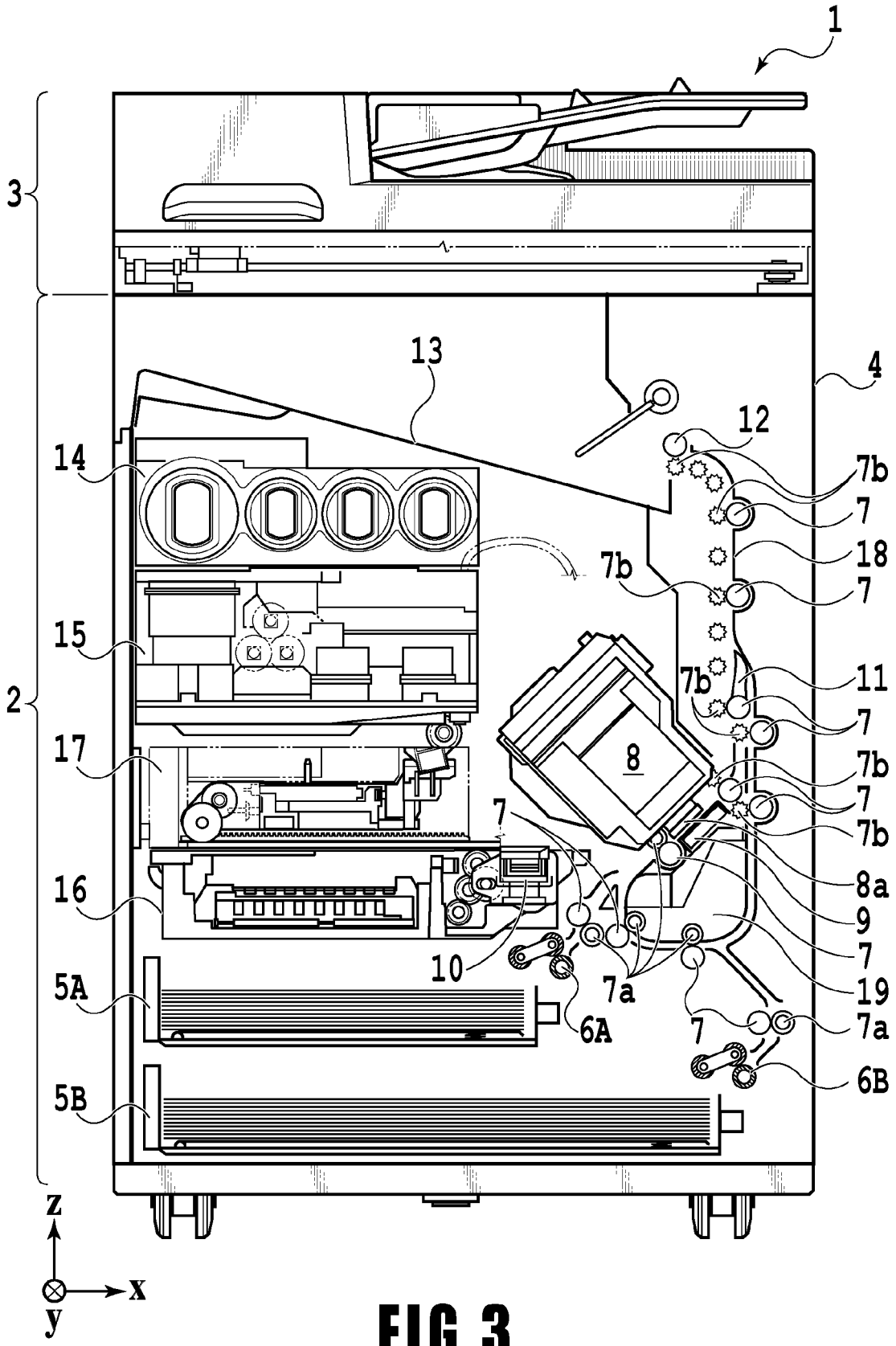
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveyance path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
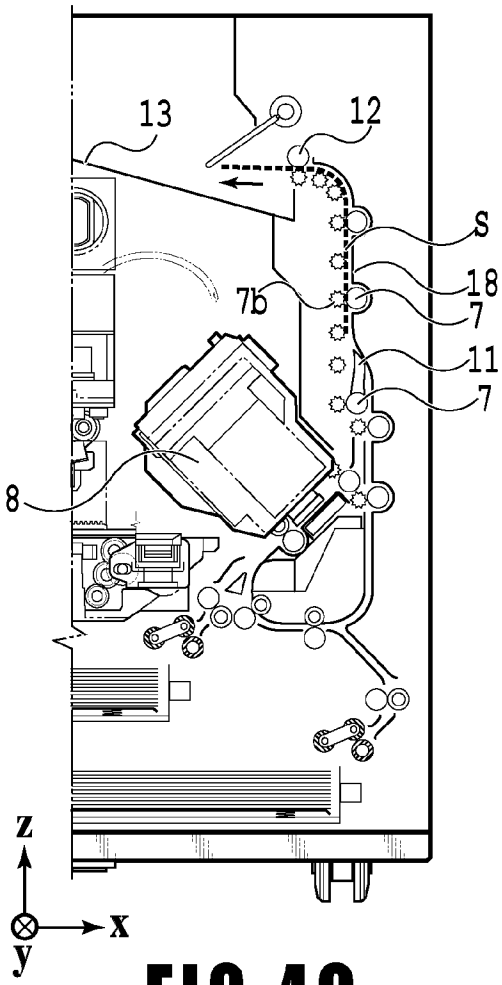
FIG. 4A, FIG. 4B, and FIG. 4C are views of a conveyance path of a print medium fed from a first cassette.
Figure 4B:
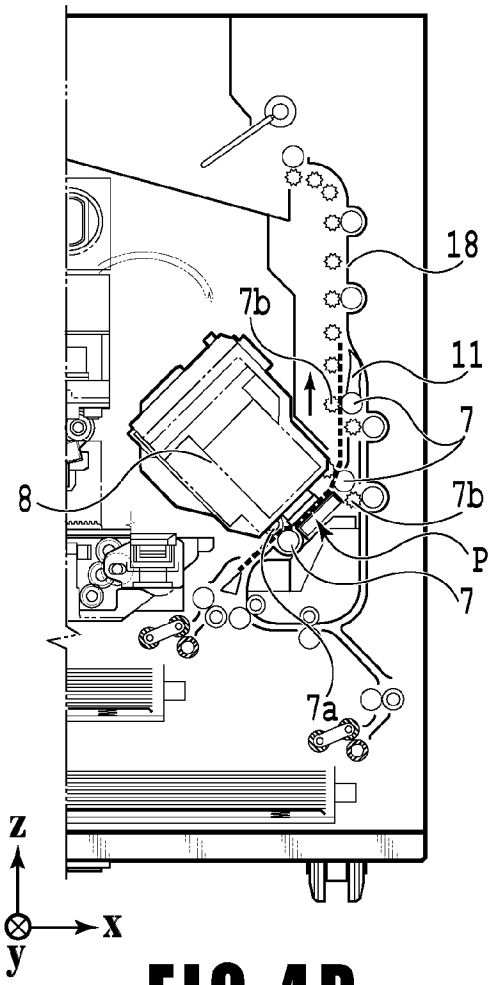
Figure 4A:
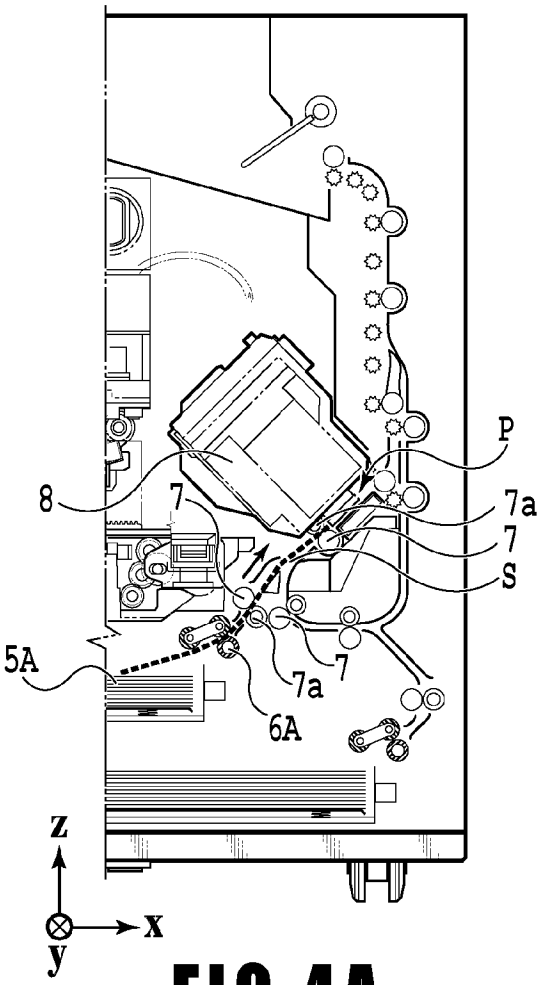

FIGS. 4A to 4C are diagrams showing a conveyance path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveyance rollers 7 and the pinch rollers 7*a*. FIG. 4A shows a conveyance state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveyance rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveyance rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
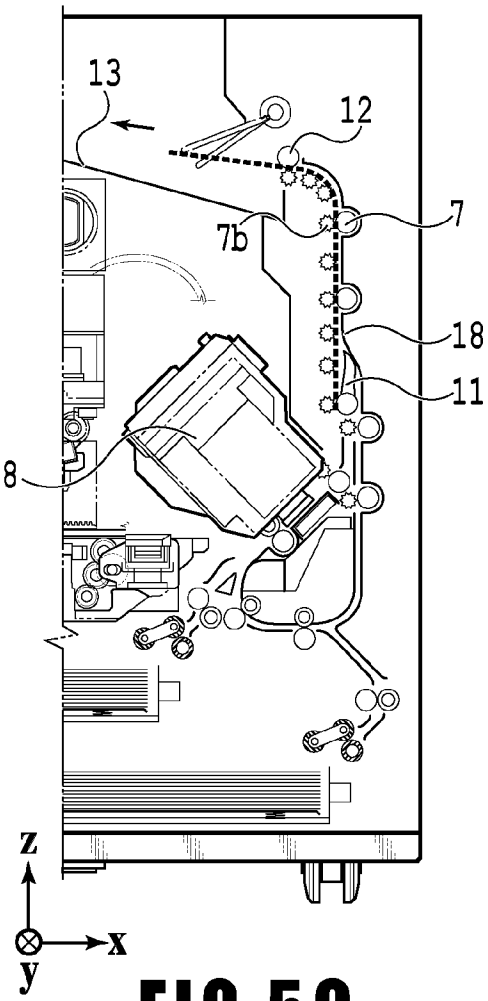
FIG. 5A, FIG. 5B, and FIG. 5C are views of a conveyance path of a print medium fed from a second cassette.
Figure 5B:
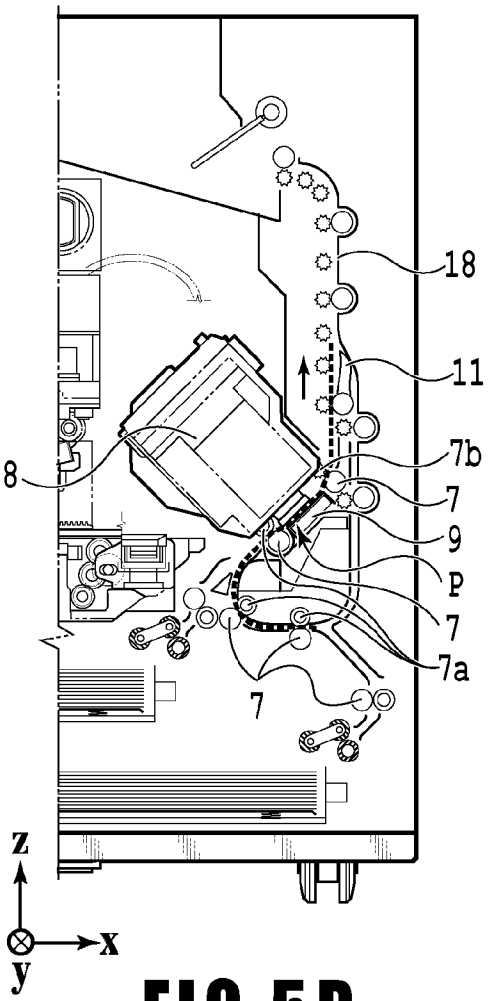
Figure 5A:
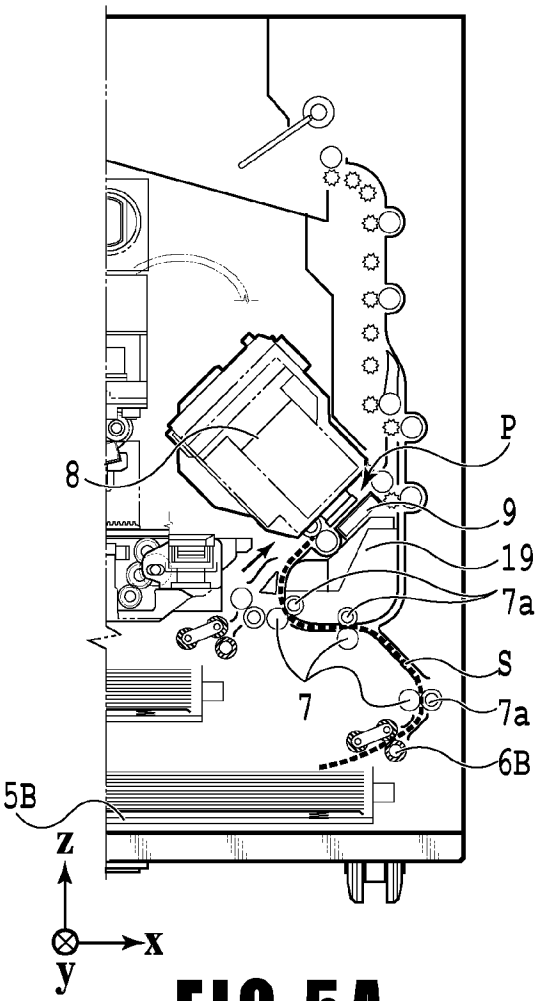

FIGS. 5A to 5C are diagrams showing a conveyance path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveyance rollers 7 and the pinch rollers 7*a*.

FIG. 5A shows a conveyance state where the front end of the print medium S is about to reach the print area P. In a part of the conveyance path, through which the print medium S is fed by the second feeding unit 6B toward the print area P, the plurality of conveyance rollers 7, the plurality of pinch rollers 7*a*, and the inner guide 19 are provided such that the print medium S is conveyed to the platen 9 while being bent into an S-shape.

The rest of the conveyance path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveyance path in the case of performing print operation (duplex printing) for the back side (second side) of an A4 size print medium S. In the case of duplex printing, print operation is first performed for the first side (front side) and then performed for the second side (back side). A conveyance procedure during print operation for the first side is the same as that shown in FIGS. 4A to 4C and therefore description will be omitted. A conveyance procedure subsequent to FIG. 4C will be described below.

Figure 6D:
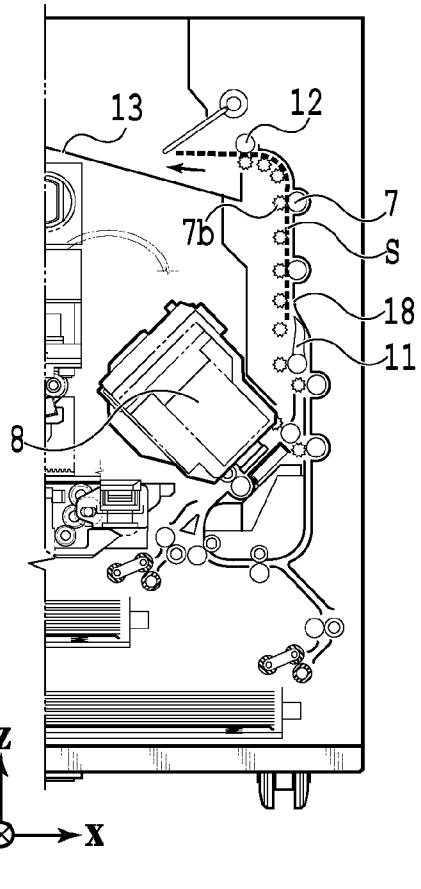
FIG. 6A, FIG. 6B, FIG. 6C, and FIG. 6D are views of views of a conveyance path used in a case of performing a print operation on the back surface of a print medium.
Figure 6C:
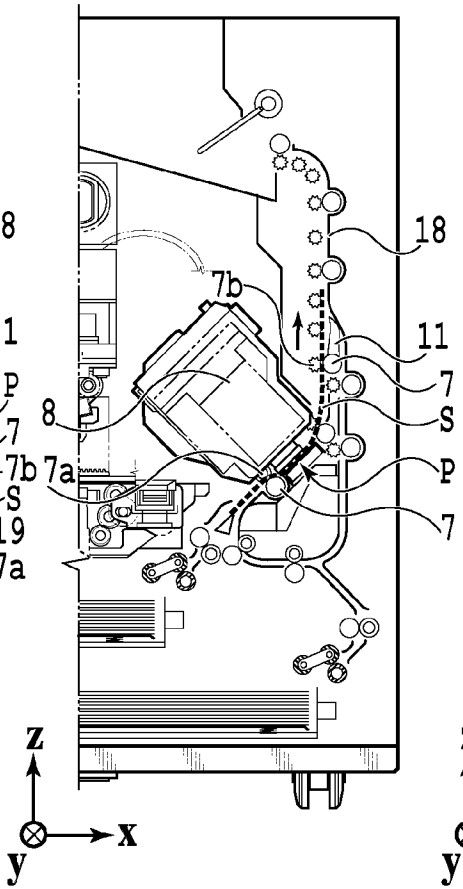
Figure 6B:
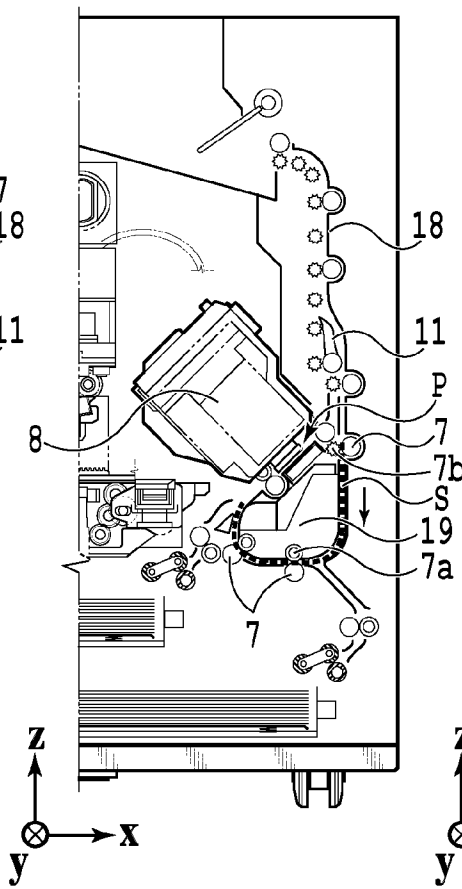
Figure 6A:
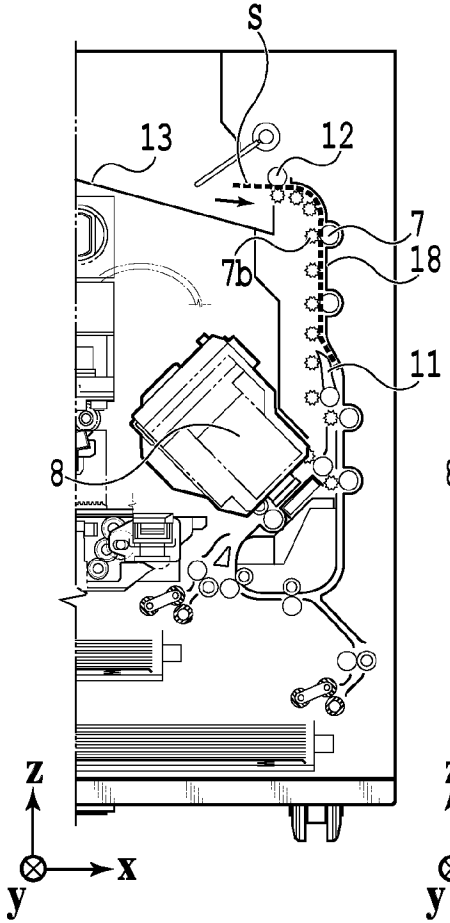

After the print head 8 finishes print operation for the first side and the back end of the print medium S passes by the flapper 11, the print controller 202 turns the conveyance rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveyance state where the front end of the print medium S is about to reach the print area P for print operation for the second side.

The rest of the conveyance path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
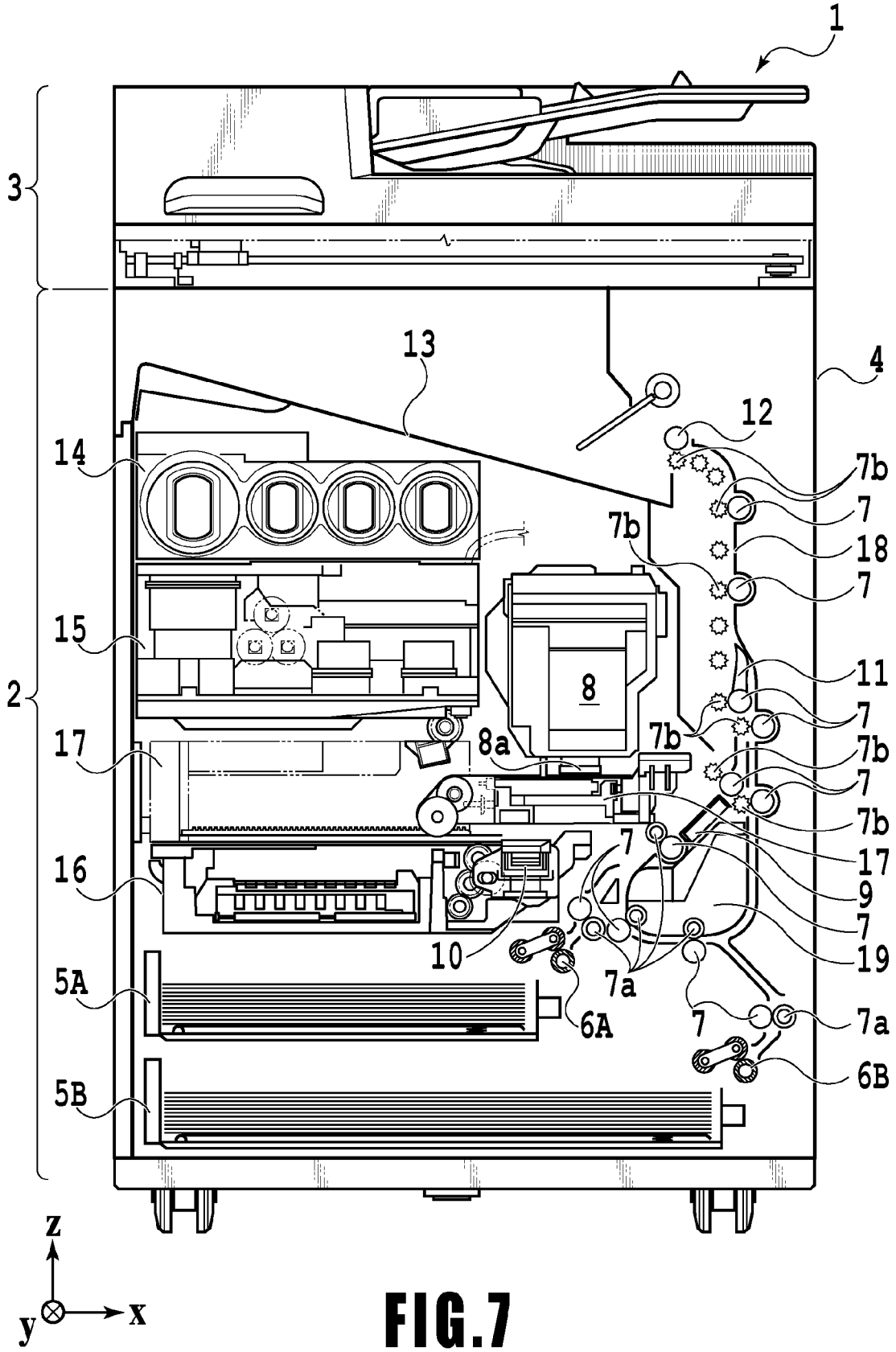
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
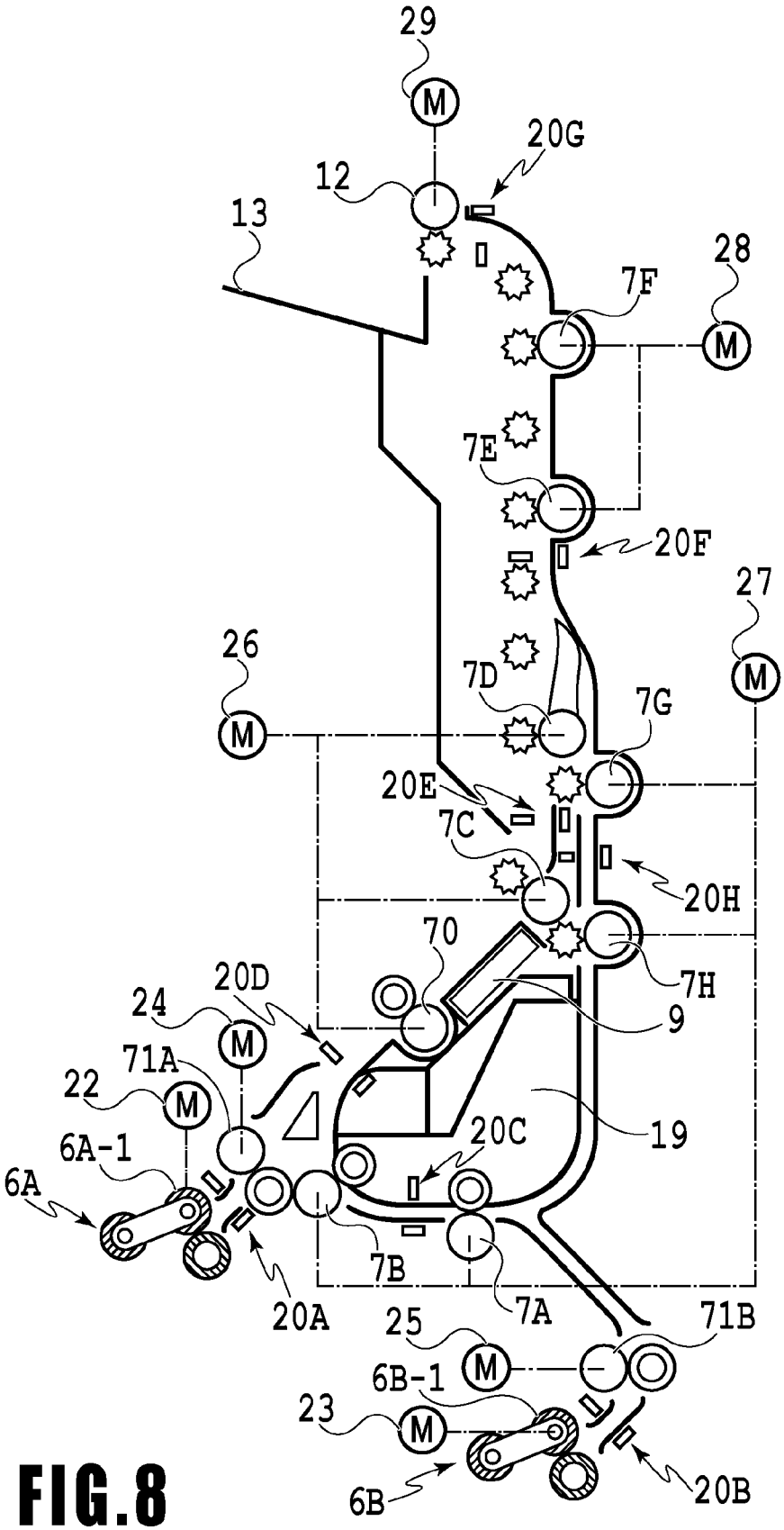
FIG. 8 is a diagram illustrating the relationship between drive rollers and motors.

FIG. 8 is a diagram illustrating the relationship between the plurality of motors and the drive rollers (conveyance unit) in the printing apparatus 1. A first feed motor 22 drives a first feed roller 6A-1 of the first feed unit 6A that feeds a print medium S from the first cassette 5A. A second feed motor 23 drives a second feed roller 6B-1 of the second feed unit 6B that feeds a print medium S from the second cassette 5B. A first conveyance motor 24 drives a first intermediate roller 71A being the first roller to convey the print medium S fed from the first feed unit 6A. A second conveyance motor 25 drives a second intermediate roller 71B being the first roller to convey the print medium S fed from the second feed unit 6B.

A main conveyance motor 26 drives a main conveyance roller 70 that is disposed upstream of the platen 9 and mainly conveys a print medium S which is being printed. The main conveyance motor 26 also drives two conveyance rollers 7C and 7D that are disposed downstream of the platen 9 and convey further downstream the print medium S conveyed by the main conveyance roller 70.

A third conveyance motor 27 drives two conveyance rollers 7G and 7H that convey downward a print medium S printed on the first surface. The third conveyance motor 27 also drives two conveyance rollers 7A and 7B that are disposed along the inner guide 19 and convey, toward the print head 8, a print medium S conveyed by the second intermediate roller 71B or a print medium S printed on the first surface and flipped upside down.

A fourth conveyance motor 28 drives two conveyance rollers 7E and 7F that convey upward or downward a print medium S having finished its printing operation. A discharge motor 29 drives the discharge roller 12, which discharges a printed print medium S onto the discharge tray 13. As described above, the two feed motors 22 and 23, the five conveyance motors 24 to 28, and the discharge motor 29 are each associated with one or more drive rollers.

On the other hand, at eight positions along the conveyance paths are disposed the sensing members 20 (sensing members 20A to 20H), each of which senses the presence or absence of a print medium S. Each sensing member 20 includes a sensor and a mirror disposed on the opposite sides of the conveyance path. The sensor, including a light emitting portion and a light receiving portion, is disposed on one side of the conveyance path while the mirror is disposed on the other side of the conveyance path at a position facing the sensor. Whether a print medium S is present, that is, whether its leading edge or trailing edge is passing, is determined based on whether light emitted from the light emitting portion of the sensor is reflected by the mirror and received by the light receiving portion.

The conveyance controller 207 controls the conveyance in the entire apparatus by individually driving the feed motors 22 and 23, the conveyance motors 24 to 28, and the discharge motor 29 based on the results of sensing by the plurality of sensing members 20 and the output values of the encoders that detect the amounts of rotation of the respective drive rollers.

As described above, the printing apparatus 1 includes the sensing units 212 (see FIG. 2) and senses conveyance trouble of a print medium S during a printing operation with these sensing units 212. Note that in the specification of the present application, any of states in which a print medium S to be conveyed is not properly conveyed, such as a jam in which the print medium S is jammed on any conveyance path and slippage in which any conveyance roller slips on the print medium S, is referred to as conveyance trouble, for example.

In the printing apparatus 1, eight sensing members 20, namely, sensing members 20A to 20H, are disposed along the conveyance paths. Note that the number of sensing members 20 disposed is not limited to eight. Each of these sensing members 20 constitutes a sensing unit 212 (sensing unit) with an encoder 21 (detection member).

The encoders 21 (not illustrated in FIG. 8) are disposed on the drive rollers associated with the sensing members 20 along the three conveyance paths and detect the amounts of rotation of the respective drive rollers. Each encoder 21 is, for example, a rotary encoder including a code wheel and an encoder sensor. The code wheel is in a disc shape, fixed to the drive roller, and rotates together with the drive roller. The code wheel includes slits extending radially and arranged annularly, and the encoder sensor senses light passing through these slits. Then, the number of times light passes through a slit is counted as a slit count, and the amount of rotation of (the amount of conveyance by) the drive roller (conveyance unit) is detected based on the measured slit count.

In this embodiment, the printing apparatus 1 includes the following three conveyance paths. Specifically, a first path is the conveyance path which a print medium S housed in the first cassette 5A is caused to pass through to print the first surface (front surface) of the print medium (hereinafter, referred to as "first conveyance path" as appropriate), such as illustrated in FIGS. 4A, 4B, and 4C. A second path is the conveyance path which a print medium S housed in the second cassette 5B is caused to pass through to print the first surface of the print medium S (hereinafter, referred to as "second conveyance path" as appropriate), such as illustrated in FIGS. 5A, 5B, and 5C. A third path is the conveyance path which a print medium S is caused to pass through to print the second surface (back surface) of the print medium S (hereinafter, referred to as "third conveyance path" as appropriate), such as illustrated in FIGS. 6A, 6B, 6C, and 6D.

Along the first conveyance path, the sensing member 20A, the sensing member 20D, the sensing member 20E, the sensing member 20F, and the sensing member 20G are disposed in this order from an upstream side in the direction of conveyance of a print medium S (simply referred to as "upstream side" as appropriate in the specification of the present application). An encoder 21 is disposed on, for example, each of the first feed roller 6A-1, the first intermediate roller 71A, the main conveyance roller 70, the conveyance roller 7C, and the conveyance roller 7D. Each encoder 21 is associated with the closest sensing member 20 on the downstream side, in the direction of conveyance (simply referred to as "downstream side" as appropriate in the specification of the present application), of the drive roller on which the encoder 21 is disposed. Thus, along the first conveyance path, five sensing units 212 senses the state of conveyance of a print medium S.

Along the second conveyance path, the sensing member 20B, the sensing member 20C, the sensing member 20D, the sensing member 20E, the sensing member 20F, and the sensing member 20G are disposed in this order from the upstream side. An encoder 21 is disposed on, for example, each of the second feed roller 6B-1, the conveyance roller 7A, the conveyance roller 7B, the main conveyance roller 70, the conveyance roller 7D, and the conveyance roller 7F. Each encoder 21 is associated with the closest sensing member 20 on the downstream side of the drive roller which the encoder 21 is disposed. Thus, along the second conveyance path, six sensing units 212 sense the state of conveyance of a print medium S.

Along the third conveyance path, the sensing member 20H, the sensing member 20C, the sensing member 20D, the sensing member 20E, the sensing member 20F, and the sensing member 20G are disposed in this order from the upstream side. An encoder 21 is disposed on, for example, each of the conveyance roller 7G, the conveyance roller 7A, the conveyance roller 7B, the main conveyance roller 70, the conveyance roller 7D, and the conveyance roller 7F. Each encoder 21 is associated with the closest sensing member 20 on the downstream side of the drive roller on which the encoder 21 is disposed. Thus, along the third conveyance path, six sensing units 212 sense the state of conveyance of a print medium S.

With such a configuration, the conveyance controller 207 can determine whether or not a print medium S is being conveyed properly, based on the times at which each sensing member 20 senses the leading edge and trailing edge of the print medium S and the amounts of rotation of the conveyance roller (slit counts) detected by the corresponding encoder 21.

Figure 9A:
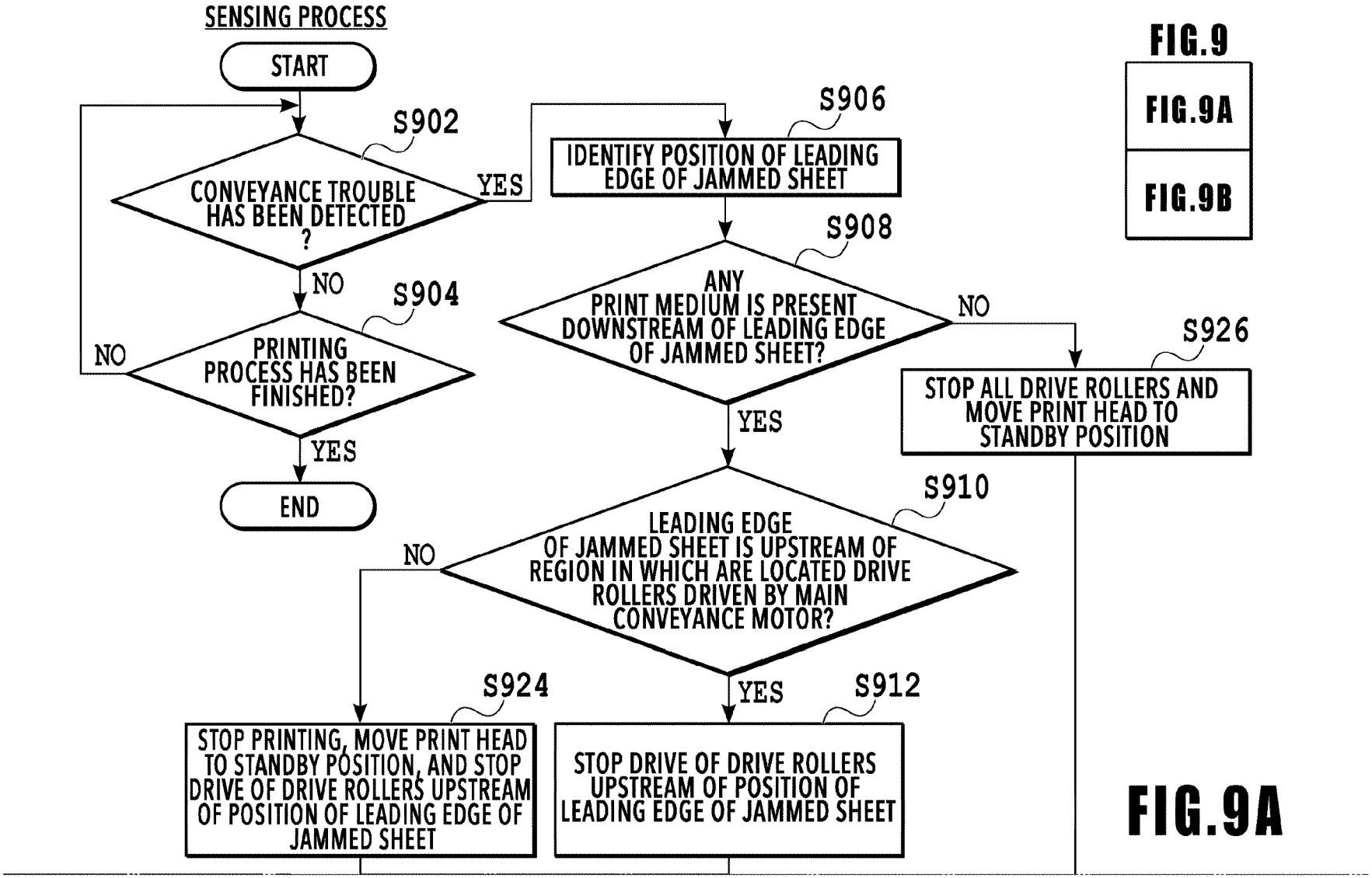
FIGS. 9A and 9B are flowcharts illustrating a detailed content of processing in a sensing process.
Figure 9B:
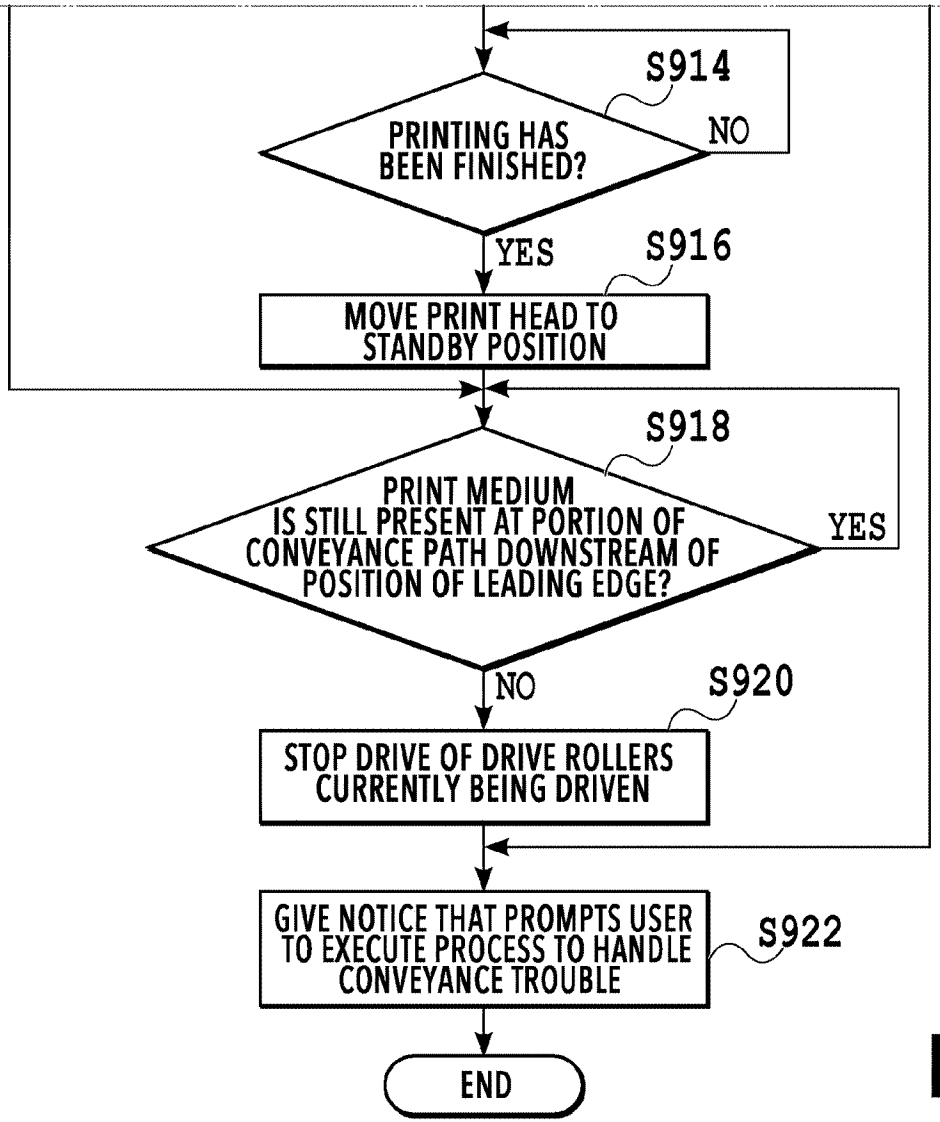

In the above configuration, upon input of a print job from the host apparatus 400, the printing apparatus 1 starts a printing process based on the print job and also a sensing process to sense conveyance trouble of any print medium S to be conveyed during the printing process. In other words, the printing apparatus 1 executes the sensing process in parallel with the printing process based on the print job. Now, this sensing process will be described in detail with reference to FIGS. 9A and 9B. FIGS. 9A and 9B are flowcharts illustrating a detailed content of the processing in the sensing process. Once the sensing processing starts, first, it is determined whether or not conveyance trouble has occurred with the print medium S currently being conveyed (S902).

Specifically, in S902, it is determined, by the conveyance controller 207, whether or not conveyance trouble has occurred based on the result of sensing by each sensing member 20 and the result of detection by the encoder 21 associated with this sensing member 20. More specifically, when, for example, the sensing member 20D detects the leading edge or trailing edge of a print medium S, the slit count detected by the encoder 21 disposed on the first intermediate roller 71A is referred to. Then, it is determined that conveyance trouble has occurred if the slit count detected by the encoder 21 associated with the sensing member 20 has not reached a first set value or has exceeded the first set value when the sensing member 20 detects the leading edge of the print medium S. Also, it is determined that conveyance trouble has occurred if the slit count detected by the encoder 21 associated with the sensing member 20 has exceeded a second set value when the sensing member 20 detects the trailing edge of the print medium S. Note that, taking into account a situation where a print medium S with a short length in the direction of conveyance may be conveyed, it is determined that conveyance trouble has not occurred if the slit count has not reached the second set value.

The first set value and the second set value are values set individually for each sensing unit 212. The first set value is the slit count of the encoder 21 that can be obtained when the leading edge of a properly conveyed print medium passes the sensing member 20. Also, the second set value is the slit count of the encoder 21 that can be obtained when the trailing edge of a properly conveyed print medium passes the sensing member 20.

If it is determined in S902 that conveyance trouble has not occurred, it is determined whether or not the printing process has been finished (S904). If it is determined in S904 that the printing process has not been finished, the processing returns to the process in S902 and the subsequent process is executed. If, however, it is determined in S904 that the printing process has been finished, this sensing process is terminated.

On the other hand, if it is determined in S902 that conveyance trouble has occurred, the position of the leading edge of the print medium S in the conveyance trouble is identified (S906). Meanwhile, in the following description, a print medium S in conveyance trouble will be referred to as "jammed sheet $S_j$" as appropriate. Specifically, in S906, the position of the leading edge of the jammed sheet $S_j$ is identified from, for example, the normal time information sensed by a sensing member 20 before the occurrence of the conveyance trouble and the amount of rotation (slit count) detected by the encoder 21 associated with this sensing member 20 before the occurrence of the conveyance trouble. For example, the position of the leading edge of the jammed sheet $S_j$ is identified based on the information of the closest sensing unit 212 upstream of the sensing unit 212 that detected the conveyance trouble.

Then, it is determined whether or not any preceding print medium or media S are present downstream of the identified position of the leading edge of the jammed sheet $S_j$ (S908). In other words, S908 is a step of making a determination based on the results of sensing by sensing members 20, and of determining whether or not the jammed sheet $S_j$ is the first-conveyed print medium S in the print job. If it is determined in this S908 that a preceding print medium or media S are present, that is, if it is determined that the jammed sheet $S_j$ is not the first-conveyed print medium S in the print job, the processing proceeds to S910. In this S910, it is determined whether or not the leading edge of the jammed sheet $S_j$ is located upstream of the region in which are located the drive rollers driven by the main conveyance motor 26. Note that the drive rollers driven by the main conveyance motor 26 are the main conveyance roller 70 and the conveyance rollers 7C and 7D. The print head 8 (platen 9) is located in the region in which these drive rollers are located. Thus, if the leading edge of the jammed sheet $S_j$ is located in this region, the jammed sheet $S_j$ is determined to be at a position where a print medium is printable by the print head 8, that is, the jammed sheet $S_j$ is determined to be currently printed. In short, in S910, it is determined whether or not the leading edge of the jammed sheet $S_j$ is located upstream of the position where a print medium is printable by the print head 8.

If it is determined in S910 that the position of the leading edge of the jammed sheet $S_j$ identified in S906 is located upstream, the drive of the drive rollers located upstream of this position is stopped (S912). Note that in S912, the drive of the drive rollers located downstream of the position of the leading edge of the jammed sheet $S_j$ is continued. Stopping the drive of the drive rollers located upstream of the position of the leading edge stops the drive rollers holding the jammed sheet $S_j$ between themselves and their driven rollers. Note that even if the motor that controls the drive of the drive rollers upstream of the position of the leading edge controls a plurality of drive rollers including a drive roller downstream of the position of the leading edge, the drive of this motor is stopped, thereby stopping all drive rollers driven by this motor.

Figure 10A:
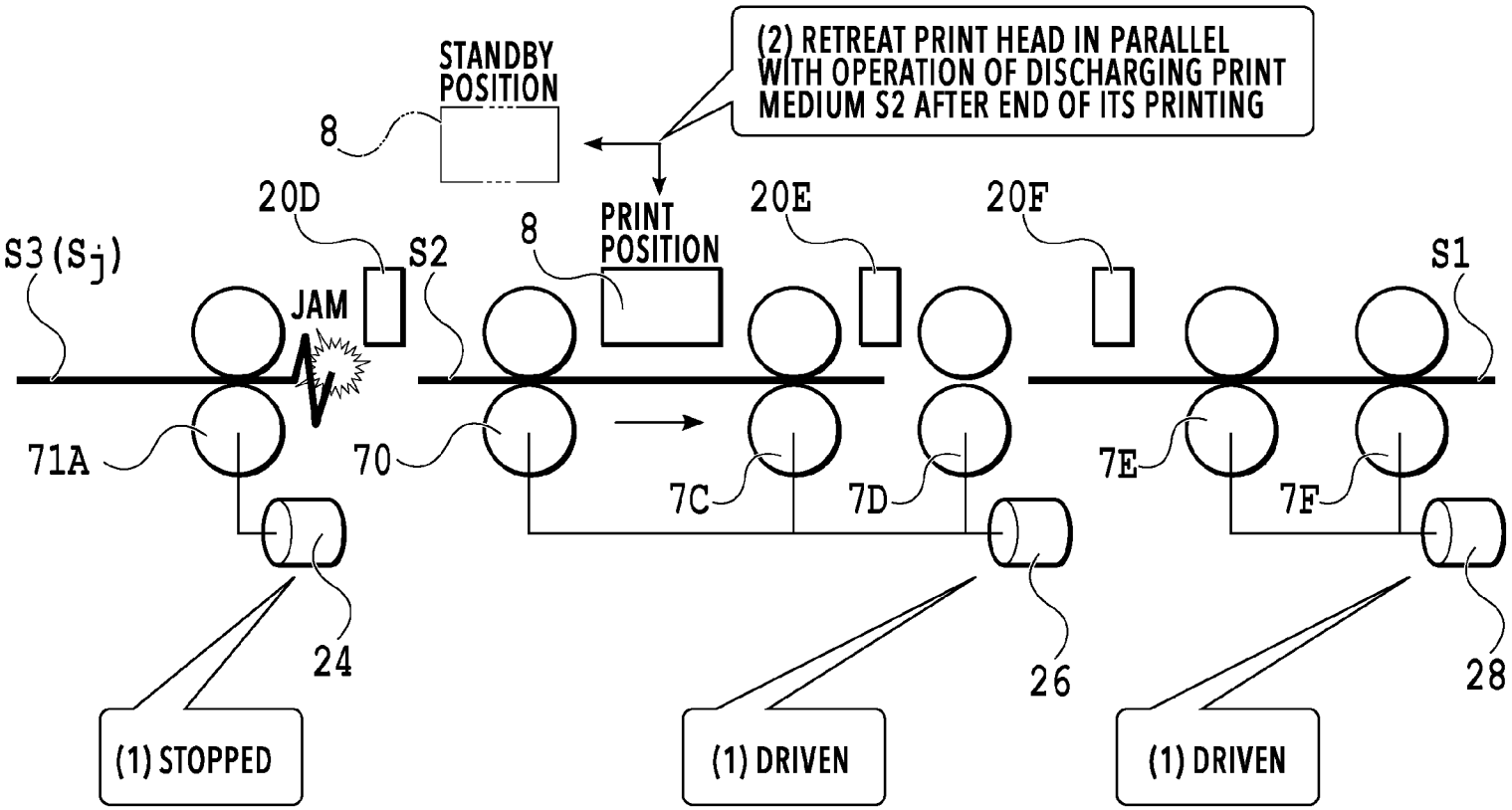
FIGS. 10A and 10B are diagrams illustrating a difference in operation resulting from a difference in position of a jammed print medium.

Here, FIG. 10A is a diagram schematically illustrating an operation performed in response to sensing conveyance trouble. FIG. 10A illustrates a situation where, among print media S1 to S3 conveyed through the first conveyance path, the print medium S3 is jammed near the first intermediate roller 71A. Note that the conveyance path is straight in FIG. 10A to facilitate the understanding.

Assume, for example, that conveyance trouble is sensed on the first conveyance path by the sensing unit 212 including the sensing member 20D and the encoder 21 disposed on the first intermediate roller 71A. In this case, as illustrated in FIG. 10A, in S912, the drive of the first conveyance motor 24 (and the first feed motor 22) is stopped while the drive of the main conveyance motor 26 and the fourth conveyance motor 28 (and the discharge motor 29) is continued (indicated by (1) in FIG. 10A). As a result, the conveyance of the print medium S3, in the conveyance trouble, (and any print medium located upstream of it) is stopped while the conveyance of the print media S2 and S1, located downstream of the print medium S3 (jammed sheet $S_j$), (and any print medium located downstream of them) is continued. Specifically, the print medium S2, which is currently printed, continues being printed while the print medium S1, which has finished being printed, undergoes a discharge operation.

Referring back to the flowchart illustrated in FIG. 9B, in S914, it is determined whether or not the printing of a print medium S located downstream of the jammed sheet $S_j$ has been finished. After the process in step S912, the print head 8 prints the print medium S that has not finished being printed among the print media S located downstream of the jammed sheet $S_j$. This print medium S that has not finished being printed is a print medium S that is at least partly located in the region in which are located the drive rollers driven by the main conveyance motor 26. Thus, in S914, it is determined whether or not the print head 8 has finished the printing of the print medium S that is present downstream of the jammed sheet $S_j$ and has not finished being printed. This determination in S914 is made based on whether or not the sensing member 20E (or the sensing member 20F) has sensed the trailing edge of the print medium S, for example.

If it is determined in S914 that the printing has not been finished, that is, if it is determined that the sensing member 20E has not sensed the trailing end of the print medium S, the processing returns to the process in S914. On the other hand, if it is determined in S914 that the printing has been finished, that is, if it is determined that the sensing member 20E has sensed the trailing edge of the print medium S, the print head 8 at the print position (first position) is moved to the standby position (second position) (S916). Here, the print medium S that has finished being printed is conveyed down to the discharge tray 13 by the conveyance rollers that are kept driven. In short, in S916, the print head 8 is moved from the print position to the standby position in parallel with the discharge operation for conveying the print medium S down to the discharge tray 13 (discharge unit) (indicated by (2) in FIG. 10A). Note that the print head 8 is configured to be movable between the print position and the standby position by the head carriage controller 208. In other words, the print head 8 starts the movement from the print position to the standby position during the operation of discharging the print medium S.

This movement of the print head 8 may be started immediately after the end of the printing of the print medium S by the print head 8 or started upon elapse of a predetermined period of time after the end of the printing, and may be started with any timing as long as it is before the end of the discharge operation. Note that the movement of the print head 8 from the print position to the standby position is preferably completed during the operation of discharging the printing medium S. Such timing may be set to vary in accordance with the position of the leading edge of the jammed sheet $S_j$ or set to remain constant regardless of the position of the leading edge of the jammed sheet $S_j$, for example. The standby position is a position to which the print head 8 is retreated from the print position, and the print head 8 located at the standby position may be capped by the cap unit 10, as in this embodiment.

Then, it is determined whether or not the print medium S is still present at the portion of the conveyance path downstream of the position of the leading edge of the jammed sheet $S_j$ identified in S906 (S918). In other words, in this S918, it is determined whether or not the discharge of the print medium S to the discharge tray 13 has been finished. This determination is made based on the results of sensing by the corresponding sensing members 20, for example. If it is determined in S918 that the print medium S is present, that is, if it is determined that the discharge of the print medium S has not been finished, the processing returns to the process in S918. On the other hand, if it is determined in S918 that the print medium S is not present, that is, if it is determined that the discharge of the print medium S has been finished, the drive rollers that have been driven up to this point is stopped (S920). Then, the user is given a notice that prompts the user to execute a process to handle the conveyance trouble (S922), and this sensing process is terminated. Note that the notice is displayed on a display unit (not illustrated) provided to the operation panel 104, for example. In doing so, various pieces of information necessary for the user to perform the process to handle the conveyance trouble, such for example as the position at which the conveyance trouble occurred, may be displayed at the same time.

Meanwhile, if it is determined in S910 that the position of the leading edge of the jammed sheet $S_j$ identified in S906 is not located upstream, the printing operation is stopped, the print head 8 is moved to the standby position, and drive rollers are stopped (S924), and the processing proceeds to S918. Note that when the leading edge of the jammed sheet $S_j$ is not determined to be located upstream, it means that the leading edge of the jammed sheet $S_j$ is determined to be located in the region in which are located the main conveyance roller 70 and the conveyance rollers 7C and 7D, driven by the main conveyance motor 26, or downstream of this region. Also, the drive rollers stopped in S924 are the drive rollers located upstream of the position of the leading edge of the jammed sheet $S_j$.

In short, in S924, the printing operation by the print head 8 is stopped, and the print head 8 is moved from the print position to the standby position. Also, in parallel with this operation, the drive rollers upstream of the position of the leading edge of the jammed sheet $S_j$ are stopped while the drive of the drive rollers downstream of the position of the leading edge is continued. The movement of the print head 8 may be started immediately after the printing is stopped or started upon elapse of a predetermined period of time after the printing is stopped. In other words, the movement of the print head 8 may be started with any timing as long as it is before the drive rollers that are kept being driven finish discharging the print medium S to the discharge tray 13 (that is, before the end of the discharge operation). Note that the movement of the print head 8 from the print position to the standby position is preferably completed during the operation of discharging the printing medium S. Such timing may be set to vary in accordance with the position of the leading edge of the jammed sheet $S_j$ or set to remain constant regardless of the position of the leading edge of the jammed sheet $S_j$, for example.

Figure 10B:
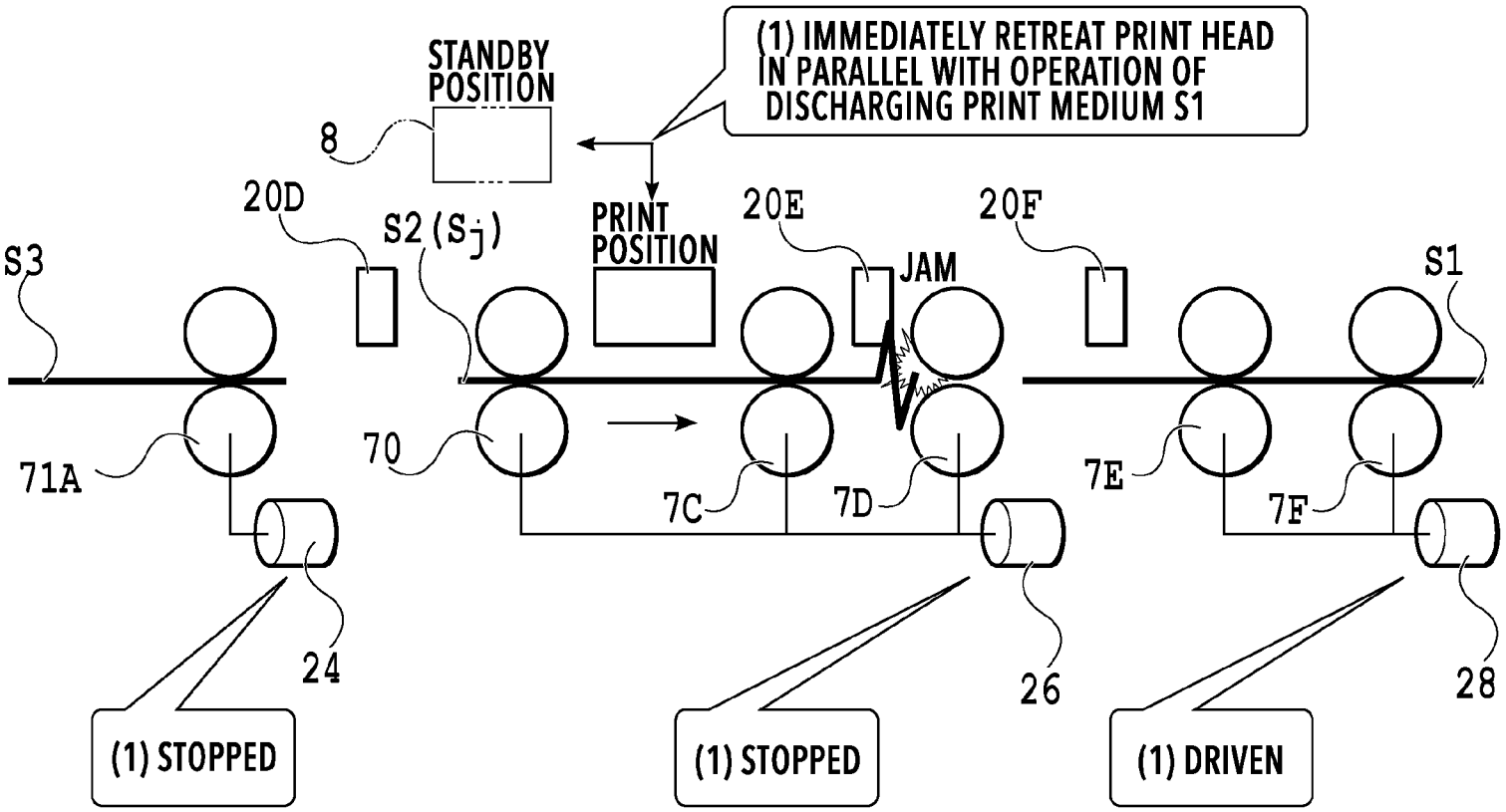

Here, FIG. 10B is a diagram schematically illustrating an operation performed in response to sensing conveyance trouble. FIG. 10B illustrates a situation where, among print media S1 to S3 conveyed through the first conveyance path, the print medium S2 is jammed near the conveyance roller 7D. Note that the conveyance path is straight in FIG. 10B, as in FIG. 10A.

Assume, for example, that conveyance trouble is sensed on the first conveyance path by the sensing unit 212 including the sensing member 20E and the encoder 21 disposed on the main conveyance roller 70. In this case, as illustrated in FIG. 10B, in S924, the printing of the print medium S2 (jammed sheet $S_j$) by the print head 8 is stopped and the print head 8 is moved from the print position to the standby position. Also, in parallel with the movement of the print head 8, the first conveyance motor 24 and the main conveyance motor 26 (and the first feed motor 22) are stopped while the drive of the fourth conveyance motor 28 (and the discharge motor 29) is continued (indicated by (1) in FIG. 10B). As a result, the print head 8 caused to stop printing the print medium S2 at the position where it is printable is moved to the standby position, while the conveyance of the print medium S2, in the conveyance trouble, and the print medium S3, located upstream of the print medium S2, (and any print medium located upstream of the print medium S3) is stopped. Meanwhile, the conveyance of the print medium S1 (and any print medium located downstream of the print medium S1) is continued to perform their discharge operation.

Also, if it is determined in S908 that no print medium S is present, that is, if it is determined that the jammed sheet $S_j$ is the first-conveyed print medium S, the drive of all drive rollers is stopped and the print head 8 is moved to the standby position (S926). Then, the processing proceeds to the process in S922, in which a notice that prompts the user to execute a process to handle the conveyance trouble is given, and this sensing process is terminated.

As described above, the printing apparatus 1 moves the print head 8 from the print position to the standby position in parallel with an operation of discharging a print medium S. Thus, with the printing apparatus 1, the time taken to prompt the user to execute a process to handle conveyance trouble after the occurrence of the conveyance trouble is shorter than that in a conventional technique in which the print head is moved to the standby position after the end of the operation of discharging the print medium S. Accordingly, the user can execute a process to handle conveyance trouble quickly after the occurrence of the conveyance trouble.

Also, the mode of sensing conveyance trouble is not limited to the above mode. For example, the following method can alternatively be employed. Upon sensing of the leading edge of a print medium S by the sensing member 20D (first sensing member), located upstream of the main conveyance roller 70, the corresponding encoder 21 is caused to start measuring the slit count. Then, upon sensing of the trailing edge of the print medium S by the sensing member 20D, the encoder 21 is caused to stop measuring the slit count. Here, it is determined that the conveyance has been done properly if the measured slit count is within a predetermined range, but it is determined that conveyance trouble has occurred if the measured slit count is outside the predetermined range. Alternatively, a mode may be employed in which, upon sensing of the leading edge of the print medium S by the sensing member 20E (second sensing member), present downstream of the sensing member 20D, after the start of the measuring of the slit count, the encoder 21 is caused to finish measuring the slit count, and it is determined whether or not the slit count is within a predetermined range. In this case too, it is determined that the conveyance has been done properly if the measured slit count is within the predetermined range, but it is determined that conveyance trouble has occurred if the measured slit count is outside the predetermined range.

Note that the above embodiment may be modified as described in (1) to (3) below.

(1) Printing apparatuses to which the present invention is applicable are not limited only to inkjet printing apparatuses, but the present invention is applicable also to printing apparatuses that perform printing on a print medium S by various methods. Also, printing apparatuses to which the present invention is applicable are not limited only to full line-type inkjet printing apparatuses as such the one in the above embodiment, but the present invention is applicable also to serial scan-type inkjet printing apparatuses, for example.

(2) Where the sensing members 20 are disposed, on which drive rollers the encoders 21 are disposed, and which driver rollers and motors are associated with each other are not limited to those in the above embodiment, but may be changed as appropriate in accordance with the shape of the conveyance paths and so on.

(3) In the above embodiment, each sensing unit 212 senses conveyance trouble based on the time information sensed by its sensing member 20 and the slit count (the amount of rotation of the drive roller) detected by the encoder associated with this sensing member 20. However, the present invention is not limited to this instance. Specifically, the sensing unit 212 may be configured in any manner as long as it is capable of sensing conveyance trouble of a print medium S currently being conveyed and identifying the position of the leading edge of the print medium, and various publicly known techniques are usable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-021193 filed Feb. 8, 2018, which is hereby incorporated by reference herein in its entirety.

What is claimed is:

1. A printing apparatus comprising:

a conveyance unit configured to convey a print medium;

a printing head configured to print an image on a print medium and configured to be movable between a first position at which the printing head performs a printing operation on a print medium conveyed by the conveyance unit, and a second position to which the printing head is retreated from the first position;

a discharge unit to which to discharge a print medium conveyed by the conveyance unit;

a sensing unit configured to sense conveyance trouble of a print medium conveyed by the conveyance unit;

a conveyance control unit configured to, upon sensing by the sensing unit of conveyance trouble during the printing operation by the printing head, control the conveyance unit to stop conveyance, to a print position for the print operation, of a print medium in the conveyance trouble and continue a discharge operation for conveying a print medium located downstream of the print medium in the conveyance trouble to the discharge unit; and a notification control unit configured to cause a notifying device to give a notice with respect to the sensed conveyance trouble to a user, wherein in response to sensing by the sensing unit of the conveyance trouble during the printing operation, (1) the printing head moves from the first position to the second position in parallel with the discharge operation by the conveyance unit and (2) after movement of the printing head to the second position, the notification control unit causes the notifying device to give the notice with respect to the sensed conveyance trouble.

2. The printing apparatus according to claim 1, wherein if a print medium in conveyance trouble is located upstream of a position where a print medium is printable by the printing head, the printing head moves from the first position to the second position in parallel with the discharge operation after a print medium that has not finished being printed finishes being printed, and wherein if a print medium in conveyance trouble is located at and downstream of the position where a print medium is printable by the printing head, the printing head stops the printing of the print medium and moves from the first position to the second position in parallel with the discharge operation.

3. The printing apparatus according to claim 1, wherein the printing head starts the movement from the first position to the second position before the discharge operation by the conveyance unit ends.

4. The printing apparatus according to claim 3, wherein the printing head completes the movement from the first position to the second position during the discharge operation by the conveyance unit.

5. The printing apparatus according to claim 1, wherein the sensing unit includes a sensing member that senses presence or absence of a print medium and a detection member that detects an amount of conveyance by the conveyance unit.

6. The printing apparatus according to claim 5, wherein the sensing member is capable of sensing a leading edge and trailing edge of a print medium, wherein the sensing unit determines that conveyance trouble has occurred if the amount of conveyance detected by the detection member when the sensing member senses a leading edge of a print medium has not reached or has exceeded a first set value, and wherein the sensing unit determines that conveyance trouble has occurred if the amount of conveyance detected by the detection member when the sensing member senses a trailing edge of a print medium has exceeded a second set value.

7. The printing apparatus according to claim 5, wherein the sensing member is capable of sensing a leading edge and trailing edge of a print medium, and wherein the sensing unit determines that conveyance trouble has occurred if the amount of conveyance detected by the detection member from when the sensing member senses a leading edge of a print medium to when the sensing member senses a trailing edge of the print medium is outside a predetermined range.

8. The printing apparatus according to claim 5, wherein the sensing members includes a first sensing member and a second sensing member disposed downstream of the first sensing member, each of which is capable of sensing a leading edge and trailing edge of a print medium, and wherein the sensing unit determines that conveyance trouble has occurred if the amount of conveyance detected by the detection member from when the first one of the sensing members senses a leading edge of a print medium to when the second one of the sensing members disposed downstream of the first sensing member senses the leading edge of the print medium is outside a predetermined range.

9. The printing apparatus according to claim 5, wherein the conveyance control unit identifies a position of a leading edge of a print medium in conveyance trouble based on a result of sensing by the sensing member and a result of detection by the detection member, and controls drive of the conveyance unit based on the position of the leading edge.

10. The printing apparatus according to claim 1, further comprising a capping unit that caps the printing head when the printing head is at the second position.

11. The printing apparatus according to claim 10, wherein the printing head includes an ejection port surface in which an ejection port for ejecting an ink is provided, and wherein the capping unit caps the ejection port surface of the printing head at the second position.

12. The printing apparatus according to claim 11, wherein the capping unit caps the ejection port surface of the printing head having moved from the first position to the second position in parallel with the discharge operation by the conveyance unit in response to sensing of conveyance trouble by the sensing unit during the printing operation.

13. The printing apparatus according to claim 12, wherein the printing head is a full line-type print head in which a plurality of ejection ports for ejecting an ink onto a print medium are aligned in a direction crossing a direction of conveyance of the print medium, the number of ejection ports corresponding to a width of the print medium in the crossing direction.

14. The printing apparatus according to claim 1, wherein the conveyance unit comprises one or more drive rollers driven by a motor.

15. The printing apparatus according to claim 1, wherein the printing head is a full line-type print head in which a plurality of ejection ports for ejecting an ink onto a print medium are aligned in a direction crossing a direction of conveyance of the print medium, the number of ejection ports corresponding to a width of the print medium in the crossing direction.

16. The printing apparatus according to claim 15, wherein the print head is a color inkjet print head.

17. The printing apparatus according to claim 1, further comprising the notifying device.

18. The printing apparatus according to claim 1, wherein after movement of the printing head to the second position, the notification control unit causes the notifying device to give the notice that prompts the user to execute a process to handle the conveyance trouble.

* * * * *